United States Patent [19]

Zitke et al.

[11] 3,937,397

[45] Feb. 10, 1976

[54] BASKET CENTRIFUGE

[75] Inventors: Ernest John Zitke, Stoughton, Mass.; Donald Dickinson Horton, Montclair, N.J.

[73] Assignee: The De Laval Separator Company, Poughkeepsie, N.Y.

[22] Filed: Aug. 28, 1974

[21] Appl. No.: 501,459

[52] U.S. Cl. ..... 233/3; 233/21; 233/32

[51] Int. Cl.[2] ..... B04B 11/04

[58] Field of Search ..... 233/3, 7, 21, 22, 27, 28, 233/46, 32

[56] References Cited

UNITED STATES PATENTS

| | | | |
|---|---|---|---|
| 416,320 | 12/1889 | Bergner | 233/21 |
| 1,623,508 | 4/1927 | Tufts | 233/2 |
| 2,256,316 | 9/1941 | Eddy | 233/7 X |
| 3,779,450 | 12/1973 | Shapiro | 233/21 |

FOREIGN PATENTS OR APPLICATIONS

| | | | |
|---|---|---|---|
| 884,812 | 12/1961 | United Kingdom | 233/3 |

*Primary Examiner*—George H. Krizmanich
*Attorney, Agent, or Firm*—Cyrus S. Hapgood

[57] ABSTRACT

A feed mixture of liquid and solids is delivered into a central nave at the lower portion of a basket mounted for rotation about a vertical axis. The nave is rigidly connected to the outer portion of the basket by spoke-like tubes in which the feed mixture is accelerated while flowing from the nave into a channel extending around the rotation axis and opening upwardly into the separating chamber in the basket's outer portion. To further reduce turbulence, the channel is closed at the top in the regions where the spoke-like tubes communicate with the channel. A discharge shoe in the basket is movable relative thereto to plow accumulated solids from the outer part of the separating chamber, so that the plowed solids fall through bottom openings of the basket between the spoke-like tubes.

5 Claims, 5 Drawing Figures

Figure 1:
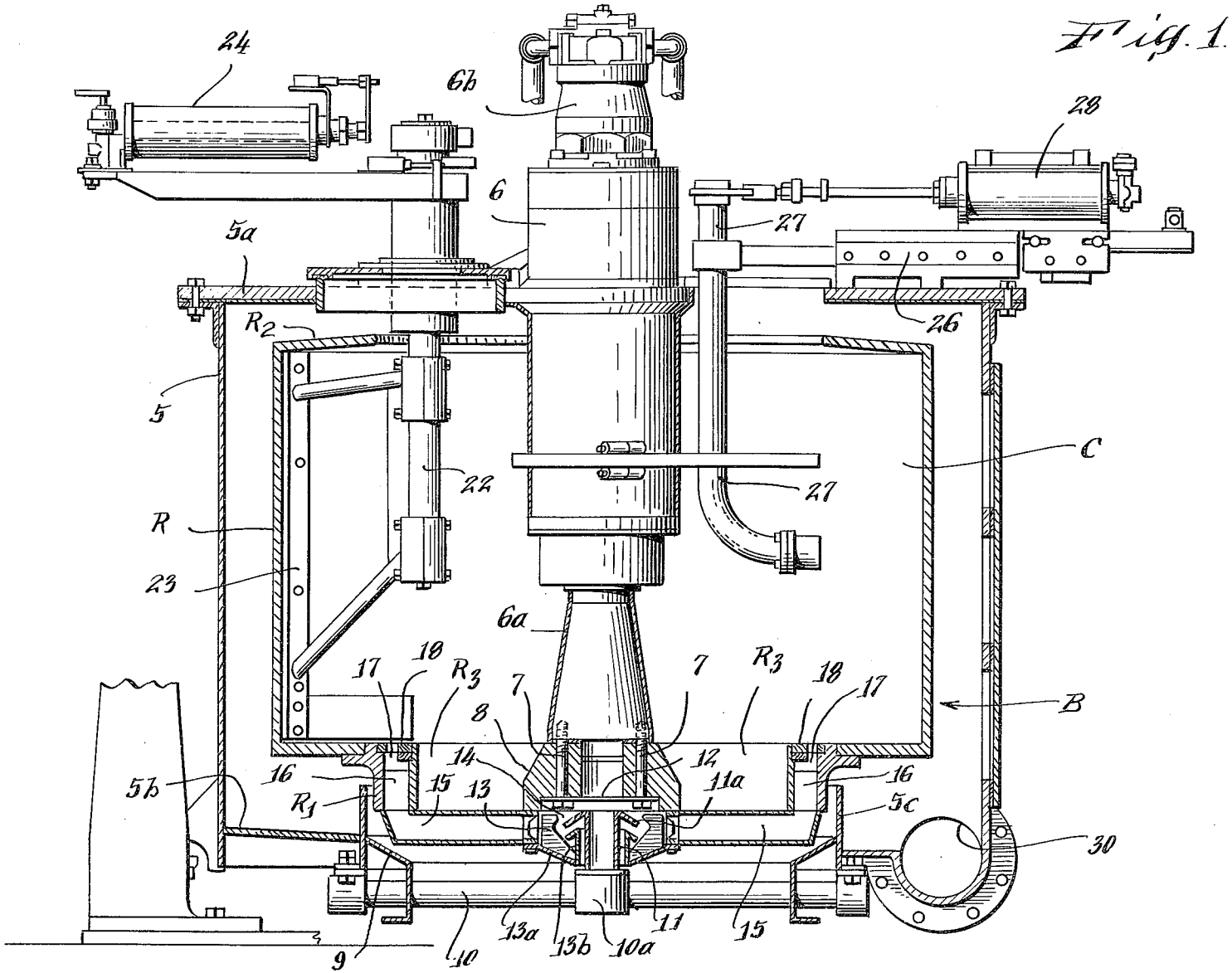

28
26
27
27
C
B
30
16
5c
17
18
R3
15
7
14
11a
11
10a
13b
13a
6a
7
8
14
13
15
R3
18
17
16
R1
9
10
6b
6
22
R2
5a
24
5
R
23
5b

BASKET CENTRIFUGE

This invention relates to basket centrifuges for separating a feed mixture of liquid and solids. More particularly, it relates to such centrifuges of the type having a discharge shoe movable relative to the rotation axis of the basket for plowing from the outer portion of its separating chamber the layer of solids which have accumulated during the separating operation, the plowed solids or sludge discharging by gravity through the bottom of the basket.

In basket centrifuges of this type, the liquid forming a lighter component of the mixture is discharged from the radially inner portion of the separating chamber either by overflowing the inner edge of a flange at one end of this chamber or by means of a skimmer tube from which the skimmed or pared liquid is discharged to a stationary outlet duct.

For the best operation of such centrifuges, the feed mixture should be accelerated to an adequate speed before it undergoes separation in the separating chamber, and such acceleration should be accomplished with a minimum of turbulence and without interfering with efficient operation of the solids discharging shoe.

These desiderata have not been adequately accomplished in prior basket centrifuges of this type. For example, certain of the prior centrifuges have relied upon radial vanes in the separating chamber for accelerating the feed mixture, as disclosed in Keith et al U.S. Pat. No. 3,734,398 of May 22, 1973, for example. However, such vanes make for difficult cleaning of the separating chamber. Also, they interfere with efficient plowing of the sludge from this chamber, in that the plowing shoe must have a gap to accommodate the vanes and this cannot contact the sludge layer continuously from the top to the bottom of the separating chamber.

The principal object of the present invention is to accomplish these desiderata in a highly effective manner.

According to the invention, the basket is mounted for rotation about a generally vertical axis and includes a central nave at its lower portion and a plurality of spoke-like tubes through which the nave is rigidly connected to the basket's outer portion forming the separating chamber. Means including a stationary feed duct are provided for delivering the feed mixture into these spoke-like tubes at their inner ends, the outer ends of the tubes communicating with the separating chamber. When the discharger shoe is actuated to plow accumulated solids from the outer part of the separating chamber, during rotation of the basket, the plowed solids discharge by gravity through bottom openings of the basket which are located between the spoke-like tubes. The latter thus serve for accelerating the feed mixture to the desired speed before it enters the separating chamber, thereby avoiding any need for accelerating vanes in this chamber; and the tubes also permit delivery of the feed mixture as well as gravity discharge of the plowed solids through the bottom of the basket.

In the preferred construction, the basket's outer portion has a channel underlying the separating chamber and extending around the rotation axis; the channel opening upwardly into this chamber; and passages from the outer ends of the spoke-like tubes open through the bottom of the channel. Preferably, the channel is closed at the top in the regions where the spoke-like tubes communicate with the channel, so that the feed mixture enters the separating chamber at locations spaced from these regions, thereby further avoiding turbulence in the separating chamber.

Figure 2:
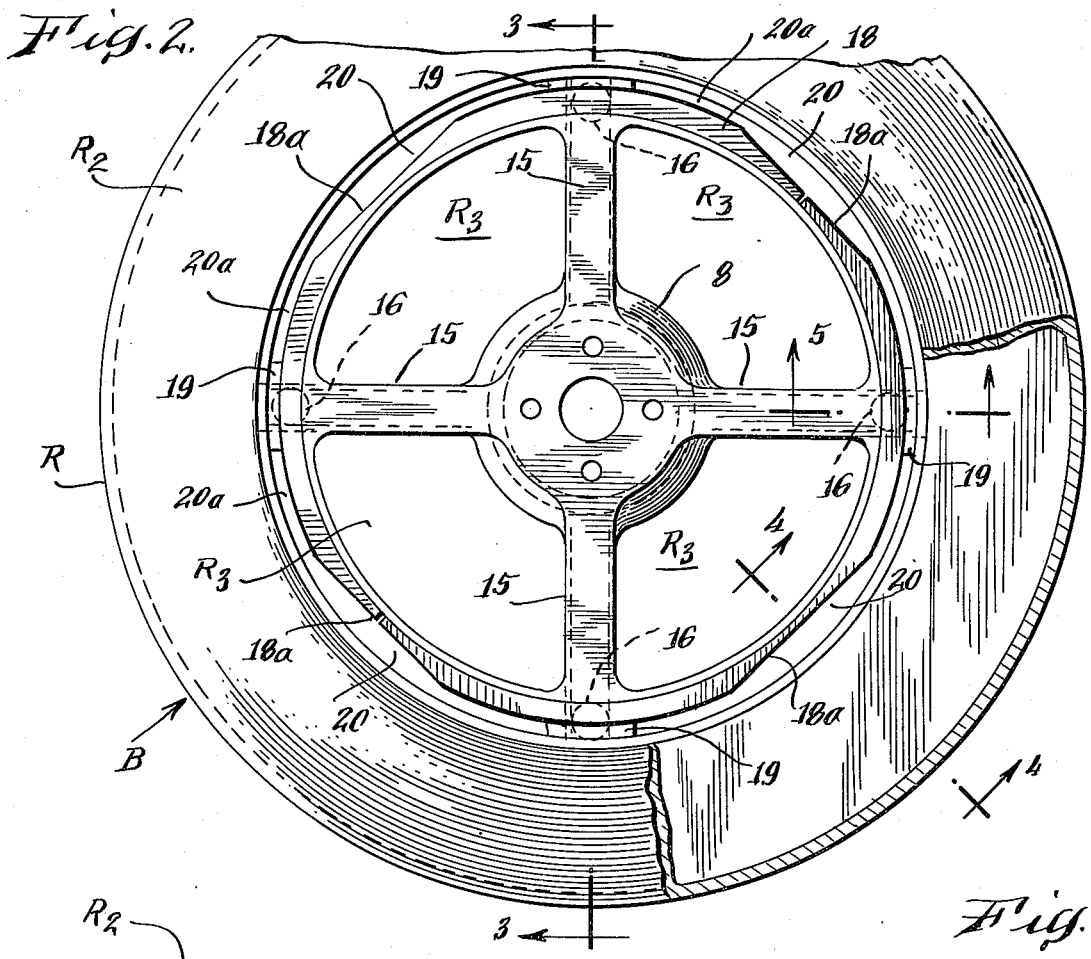
Figure 3:
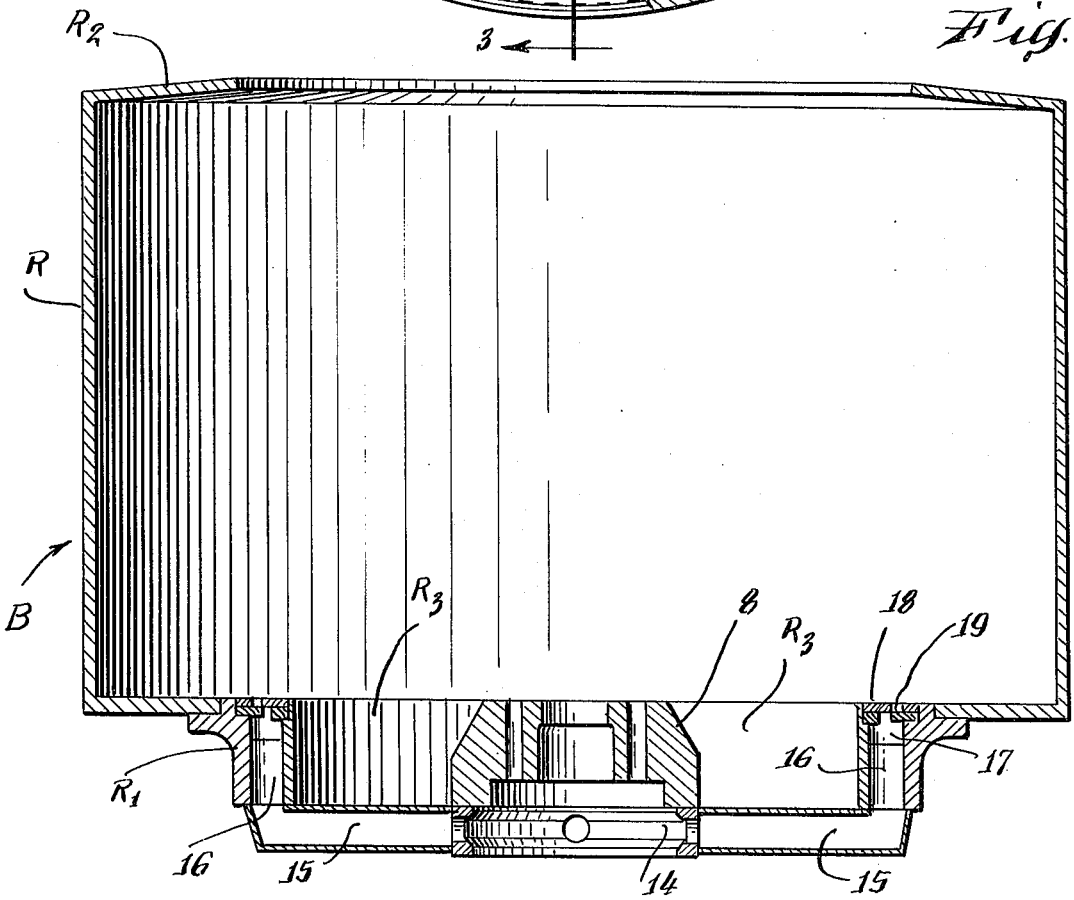
Figure 4:
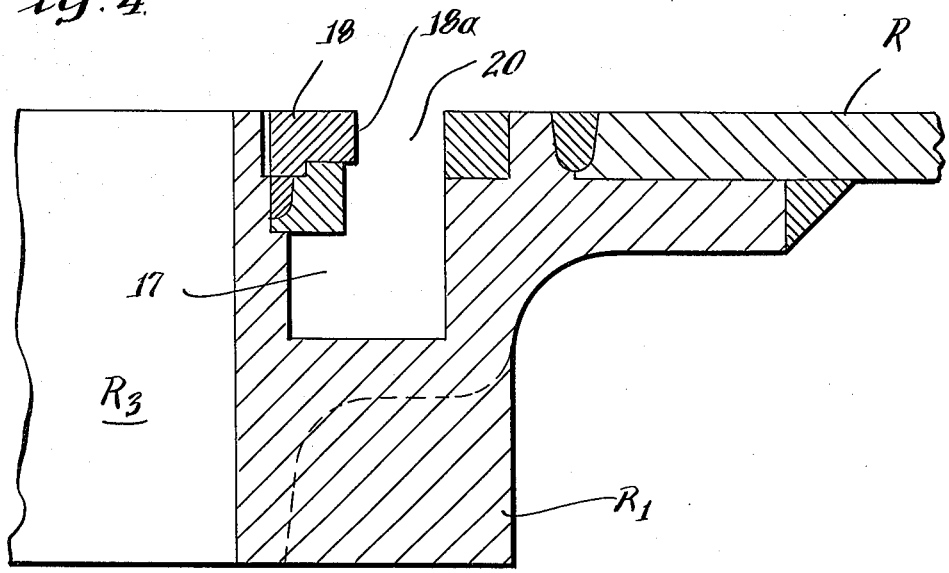
Figure 5:
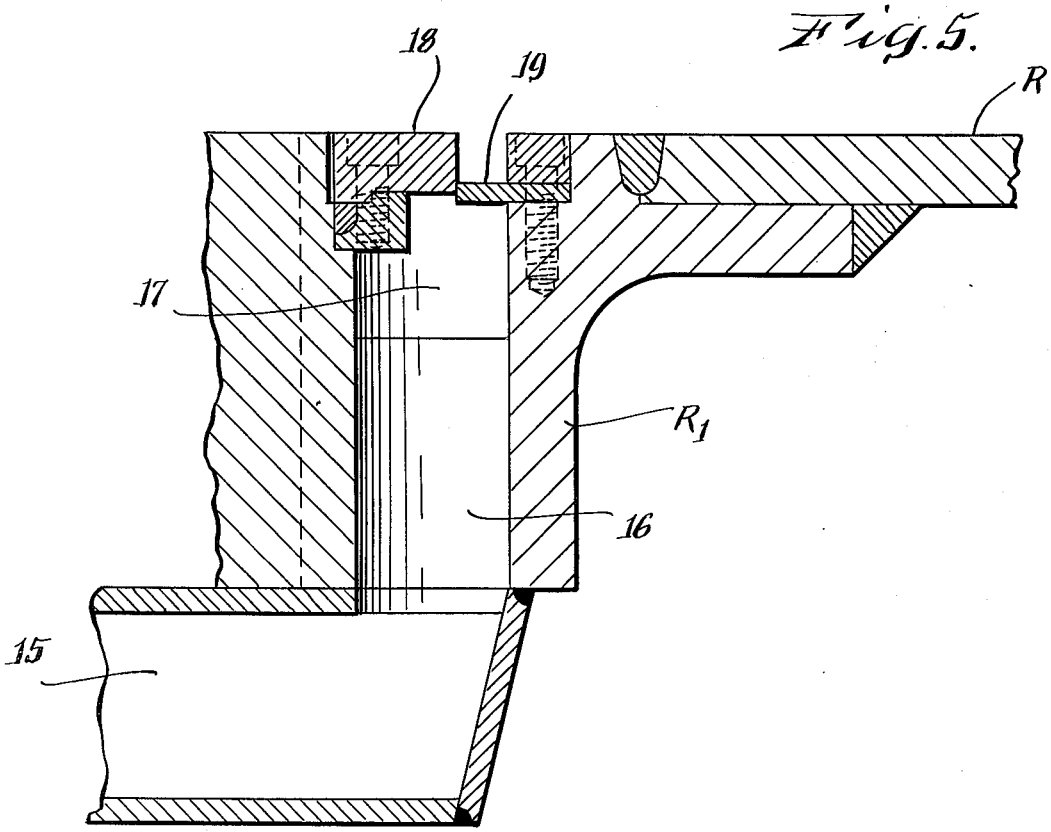

These and other features of the invention will be described in detail in the following description taken in conjunction with the accompanying drawings, in which FIG. 1 is a vertical sectional view, partly in elevation, of one form of the new centrifuge;

FIG. 2 is a plan view of the basket or rotor of the centrifuge shown in FIG. 1;

FIG. 3 is a sectional view on line 3—3 in FIG. 2, with certain parts of the basket removed, and FIGS. 4 and 5 are enlarged sectional views on lines 4—4 and 5—5, respectively, in FIG. 2.

As shown, the centrifuge comprises a rotor or basket B mounted for rotation about a vertical axis and located in a stationary housing 5. The basket B includes an outer imperforate annular part R having a lower portion R1 of reduced diameter and an inwardly extending flange R2 at the top.

Housing 5 has a top 5*a* supporting a central stationary structure 6 in which a spindle 6*a* is journalled. At its lower end, the spindle is secured by bolts 7 to a central nave 8 forming an inner part of the basket B and located at its lower portion. A suitable motor 6*b* is mounted on top of the stationary structure 6 and serves to drive the spindle 6*a*.

Thus, basket B is centrally suspended from the stationary housing top 5*a* and is adapted to be driven by motor 6*b* about a vertical axis through spindle 6*a* mounted in the central stationary structure 6.

At its lower portion, the housing 5 is provided internally with an annular gutter 5*b* having a circular inner wall 5C which surrounds the reduced lower portion R1 of basket B in spaced relation thereto. A funnel-like member 9 is secured to circular wall 5C within the latter and underlies the reduced lower portion of basket B.

A stationary feed pipe 10 extends horizontally through the side wall of funnel 9 to a hollow member 10*a* located on the rotor axis and from which a stationary feed duct 11 extends upwardly into the lower portion of basket B. The feed mixture of liquid and solids is delivered into pipe 10 by a pump (not shown) and discharges through the upper end of stationary duct 11 against a horizontal disc 12 secured to the central nave 8 of the basket. From the rotating disc 12, the feed mixture is deflected downwardly and outwardly along a conical flange 11*a* at the top of duct 11 and is picked up by a set of radial vanes 13 in a feed chamber 14 of the basket.

The vanes 13 are spaced around the rotor axis and secured to a member 13*a* forming the bottom of chamber 14, this bottom member having a central vertical tube 13*b* surrounding feed duct 11 in spaced relation thereto. The lower portion of nave 8 is hollow to form the feed chamber 14, and the bottom member 13a is secured to the part of nave 8 surrounding chamber 14. For the sake of clarity, the bottom member 13*a*, with its vanes 13 and tube 13*b*, is not shown in FIG. 3.

Basket B has four radial tubes 15 through which central nave 8 is rigidly connected to the reduced lower portion R1. As shown in FIG. 2, the tubes 15 are spaced 90° apart and partly define four sector-shaped openings R3 in the bottom of the basket. The spoke-like tubes 15 are substantially square in cross-section and open at their inner ends into the feed chamber 14 (FIG. 3). At their outer ends, the tubes 15 open into the lower ends of vertical passages 16 in the reduced portion R1. Passages 16 open into the bottom of a channel 17 formed in the reduced portion R1 and extending around the rotation axis of the basket.

Channel 17 is partly closed at the top by a ring 18 secured to the reduced portion R1 and overlying the inner portion of the channel. Opposite the outer end of each radial tube 15 is a plate 19 secured to the reduced portion R1 and overlying the outer portion of channel 17, each plate 19 contacting the outer edge of ring 18 (FIG. 5). In the four sectors between adjacent radial tubes 15, the outer edge of ring 18 is cut back, as shown at 18*a*, thereby providing openings 20 of maximum width at the top of channel 17.

Thus, the top of channel 17 is closed at the regions of the radial tubes 15 and has an opening 20 of maximum width at each of the four regions located midway between adjacent plates 19. Between each plate 19 and an adjacent maximum opening 20 is a relatively narrow opening 20*a*.

Mounted on the top 5*a* of stationary housing 5 is a vertical shaft 22 extending downward into the rotary basket B. Shaft 22 carries at its lower portion a shoe assembly 23 for plowing sludge from the outer peripheral portion of the separating chamber C formed by basket B. Above the housing top 5*a*, the shaft 22 is connected to a suitable power-mechanism 24 for rotating the shaft to move the shoe assembly 23 to or from its position for plowing sludge from the basket.

Also mounted on the housing top 5*a* is a bracket 26 which supports a skimmer tube 27 for radial movements, the skimmer tube extending downward into the basket B. Radial movements of the tube 27 are effected by a suitable power source 28. When tube 27 is moved outward to immerse its lower end in a body of liquid in the rotating basket, liquid is skimmed or pared from this body and discharges to a stationary duct (not shown) connected to the upper end of tube 27.

The assembly 22–24 for plowing sludge from the rotating basket B, and the assembly 26–28 for skimming liquid from the rotating basket, may be of any form known in the art.

The upper flange R2 of basket B determines the maximum liquid level therein, in that liquid normally overflows the inner edge of flange R2 during operation of the centrifuge. This overflowing liquid is thrown radially outward and then flows downward into the collecting gutter 5*b*, from which it discharges through an outlet pipe 30 (FIG. 1).

In the operation of the centrifuge as illustrated, the basket B is brought up to its normal operating speed by the motor 6*b*, and the feed mixture is fed under pressure through the stationary pipe 10 and its upward extension 11. After the feed mixture is deflected downwardly and outwardly from the rotating disc 12, it is brought up to speed by the radial vanes 13 in the feed chamber 14 of the basket. The feed mixture then passes outwardly through the spoke-like tubes 15, which further act to accelerate the mixture. After entering the channel 17 by way of vertical passages 16, the feed mixture discharges through the openings 20–20*a* into the main chamber C of the basket. The plates 19 prevent discharge of the mixture directly into this main chamber from the regions of the radial fins 15, so that the liquid must flow circumferentially in the channel 17 before discharging through the top openings 20–20*a*. In this way, the feed mixture enters the separating chamber of the basket with a minimum of turbulence, thereby facilitating the centrifugal separation.

It will be understood that the solids of the feed mixture, being heavier than the liquid, accumulate in the outer peripheral portion of the basket chamber C due to the action of centrifugal force; and at the same time liquid discharges as a relatively light component over the inner edge of basket flange R2 and into the housing gutter 5*b* for eventual discharge through outlet pipe 30. When it is desired to skim liquid from the basket, the skimmer tube 27 is moved radially outward to immerse its lower end in the liquid body, as previously described. Of course, the tube 27 may be used for skimming a relatively heavy liquid which forms an annulus between the sludge at the outer periphery of the basket and a body of relatively light liquid which normally overflows the flange R2. Alternatively, in some cases the tube 27 may be positioned to skim liquid from the rotating basket so that there will be no discharge over the flange R2.

During the accumulation of sludge in the outer portion R of the basket, shaft 22 holds the shoe assembly 23 in a retracted position so that it is located radially inward from the liquid level determined by flange R2. When sludge is to be discharged, shaft 22 is rotated to swing the shoe assembly outward into engagement with the sludge layer and eventually to its outermost position closely adjacent the basket's outer wall, as shown in FIG. 1. The sludge thus plowed from the peripheral portion of the rotating basket falls through the bottom openings R3 between the spoke-like tubes 15 and thence through the stationary funnel member 9 to a suitable destination (not shown).

Thus, the radial tubes 15 not only accelerate the feed mixture as it flows outward to channel 17 at the lower portion of the basket but they also permit diacharge of plowed sludge by gravity through the basket's lower portion. Moreover, this arrangement for accelerating the feed mixture permits the shoe assembly 23 to act upon the entire sludge layer from the top to the bottom thereof, without interruption to accommodate accelerating vanes or the like. Also, due to the absence of accelerating vanes in the main chamber C of the basket, the latter is easy to clean.

Furthermore, due to the above-described arrangement for accelerating the feed mixture, in conjunction with the arrangement of outlet openings 20–20*a* from channel 17, the feed mixture entering the basket chamber C has been brought up to the desired rotational speed with a minimum of turbulence.

It will be understood that the parts R1, 18 and 19 constitute means forming feed distribution passages 16–17 leading from the outer ends of tubes 15 and opening upwardly into the separating chamber C at regions 20 which are offset laterally from these tubes and which extend along the radially outer portions of the bottom openings R3.

We claim:

1. In a basket centrifuge for separating a feed mixture of liquid and solids, the combination of a basket mounted for rotation about a vertical axis and having an outer portion forming a separating chamber, the basket including a central nave at its lower portion and also including a plurality of spoke-like tubes secured at their inner ends to the nave and at their outer ends to said outer portion of the basket, the basket having bottom openings partly defined by said tubes, means including a stationary feed duct for delivering said mixture into said tubes at their inner ends, a discharger shoe movable relative to the basket for plowing accumulated solids from the outer portion of the separating chamber, whereby the plowed solids fall through said bottom openings, and means forming feed distribution passages leading from the outer ends of the tubes and opening upwardly into the separating chamber at regions offset laterally from the tubes and extending along the radially outer portions of said bottom openings.

2. The combination of claim 1, in which said passage forming means define an endless channel located below the separating chamber and extending around said rotation axis, the tubes communicating at their outer ends with said channel, the passage forming means including plate members closing the top of said channel at the parts thereof where the tubes communicate with the channel, the channel opening upwardly into the separating chamber between said plate members to form said laterally displaced regions of the distribution passages.

3. The combination of claim 2, in which the tubes communicate with said channel through bottom openings of the channel.

4. The combination of claim 2, in which the channel opens upwardly into the separating chamber through openings which are of maximum width substantially midway between said plate members.

5. The combination of claim 1, in which said distribution passages open upwardly into the separating chamber through openings which are of maximum width substantially midway between the outer ends of the tubes.

* * * * *